United States Patent [19]

Hogenson

[11] 4,256,299

[45] Mar. 17, 1981

[54] MULTIPLE SHEET SENSOR AND DEFLECTOR

[75] Inventor: Raymond A. Hogenson, Shoreview, Minn.

[73] Assignee: Minnesota Mining and Manufacturing Company, St. Paul, Minn.

[21] Appl. No.: 58,527

[22] Filed: Jul. 18, 1979

[51] Int. Cl.[3] ..... B65H 7/12; B65H 5/06

[52] U.S. Cl. ..... 271/262; 271/272; 271/302

[58] Field of Search ..... 271/256, 262, 263, 272–274, 271/285, 286, 302

[56] References Cited

U.S. PATENT DOCUMENTS

| | | | |
|---|---|---|---|
| 2,278,518 | 4/1942 | Kenny et al. | 271/302 |
| 2,337,064 | 12/1943 | Peters . | |
| 2,670,954 | 3/1954 | Bach | 271/263 |
| 2,890,884 | 6/1959 | Mestre . | |
| 3,185,473 | 5/1965 | Miaskoff et al. | 271/262 |
| 3,202,421 | 8/1965 | Ganz | 271/274 |
| 3,266,799 | 8/1966 | Ingalls . | |
| 4,008,891 | 2/1977 | Buys | 271/263 |

*Primary Examiner*—Bruce H. Stoner, Jr.
*Attorney, Agent, or Firm*—Cruzan Alexander; Donald M. Sell; John C. Barnes

[57] ABSTRACT

A device for sensing the condition of multiple sheets during a feed of paper employing a rotatable drive roll and a rotatable backup roll eccentrically and pivotally mounted with respect to the drive roll. The device utilizes the frictional force that a sheet of paper exerts on the backup roll, as paper is driven by the drive roll through the nip which exists between the drive roll and backup roll, to pivot the backup roll around the drive roll until the backup roll reaches a position where the frictional force of the paper against the backup roll is no longer able to push the backup roll. This position is proportional to the thickness of the paper being fed. The presence of multiple sheets of paper can be detected by an ulterior position of the backup roll due to the increased thickness of the multiple sheets.

3 Claims, 3 Drawing Figures

MULTIPLE SHEET SENSOR AND DEFLECTOR

BACKGROUND OF THE INVENTION

This invention relates to a device for sensing a condition in which multiple sheets of paper have been fed into an office machine.

It is a common occurence in office machines utilizing paper sheet feeders to have a condition in which multiple sheets of paper have been fed into a processsing path when only one sheet was desired. Many patents have issued for devices to sense this condition and deflect the multiple sheets before they jam up the machine or cause defective processing. These devices however, generally use complex mechanical linkages or the combination of mechanical linkages and electrical sensors. It is inherent in these devices that as the complexity increases the manufacturing cost and susceptibility for failure observes a similar pattern.

SUMMARY OF THE INVENTION

The present invention relates to a simplified and cost-effective device for sensing the condition of multiple sheets during a feed of paper, and furthermore, deflecting the multiple sheets to prevent their defective processing.

This multiple sheet sensor and deflector apparatus comprises a drive roll which is mounted in a frame and driven by an appropriate drive means. There is also a backup member mounted such that it can pivot around the drive roll, but having a pivotal axis slightly offset from the axis of the drive roll. This mounting arrangement results in an eccentric condition where the distance between the backup member and the drive roll will vary as the backup member pivots around the drive roll. This invention utilizes the frictional force that a sheet of paper exerts on the backup member, as that sheet of paper is driven between the drive roll and the backup member, to pivot the backup member around the drive roll until the backup member reaches a position where the frictional force can no longer push the back-up member against the bias of a spring. This position is proportional to the thickness of the paper being fed. If multiple sheets are fed the increased thickness will pivot the backup member to a different position proportional to the thickness of the multiple sheets. This difference of position can be detected or used to deflect the multiple sheets.

DESCRIPTION OF THE ACCOMPANYING DRAWING

The present invention will be further described hereinafter with reference to the accompanying drawing wherein.

DETAILED DESCRIPTION OF THE PREFERRED EMBODIMENT

Figure 1:
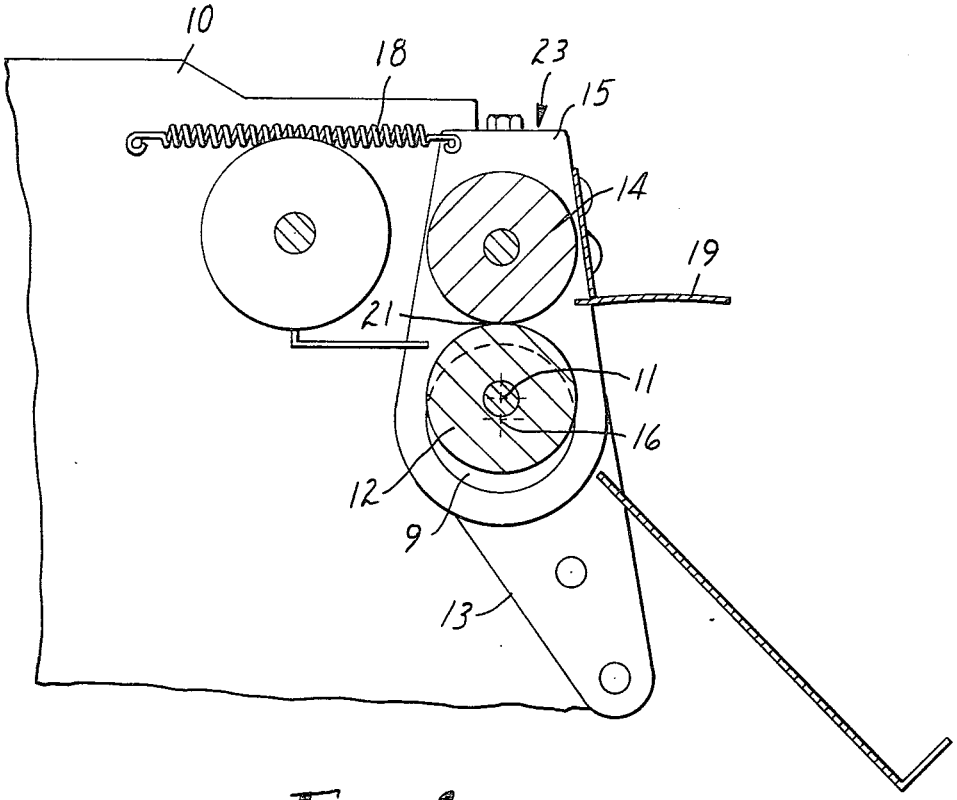
FIG. 1 is a vertical sectional view of the present invention illustrating its position when no sheets are being fed.
Figure 2:
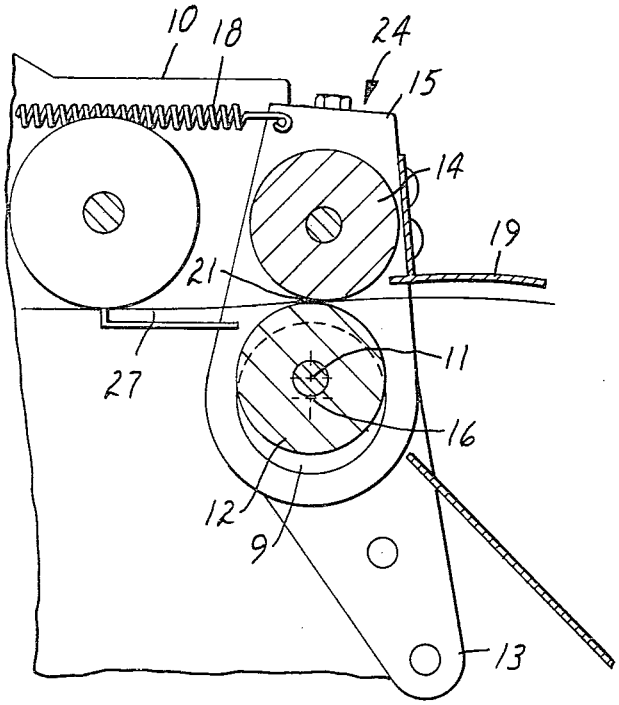
FIG. 2 is a similar view of the present invention illustrating its position during the feed of a single sheet.
Figure 3:
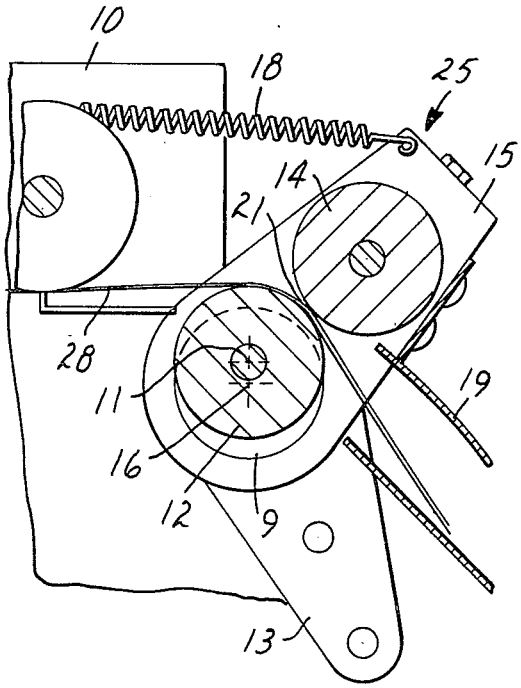
FIG. 3 is a similar view of the present invention illustrating its position during the feed of multiple sheets.

The device according to the present invention is illustrated in FIG. 1–3 wherein a drive roll 12 is journaled for rotation about a fixed axis 11 positioned eccentric to an axis 16 for a pair of bosses 9 supported by transversely spaced brackets 13 from a frame 10. The drive roll 12 is driven by an appropriate drive means (not shown) which typically involves a drive gear affixed to one end of the drive roll which can mesh with the main drive of a copy machine. A backup member 14 is located parallel to the drive roll 12 creating an elongate nip area 21 between their surfaces. The backup member 14 is a roll journaled for rotation in a carriage member 15 having transversely spaced arms which are formed with an enlarged aperture to receive the boss 9. The carriage member 15 is journalled about this boss 9 to afford the partial revolution of the backup roll 14 around the drive roll 12. This carriage member 15 is disposed such that its axis of revolution 16 is offset by approximately 3 mm (0.12 inch) from the drive roll's fixed axis 11. This distance is less than the diameter of the drive roll. This mounting arrangement results in an eccentric condition where the distance between the backup roll 14 and the drive roll 12 will vary as the backup roll 14 revolves around or partially encircles the drive roll 12 due to the pivatal movement of the carriage member 15. The backup roll 14 and the drive roll 12 are furthermore arranged, such that at one pivotal position of the backup roll 14, referred to as its home position 23, see FIG. 1, the distance between the backup roll 14 and the drive roll 12 is less than the thickness of one sheet of paper. The backup roll 14 is biased to this position by a spring 18 fastened between the carriage member 15 and the frame 10. Spring pins (not shown) located in frame 10 limit the pivotal movement of the back-up roll 14 to an angle of about 110° from the home position. A deflector plate 19 for deflecting the paper sheets is affixed to the carriage member 15.

As a single sheet of paper 27 is fed into the nip area 21 created between the backup roll 14 and the drive roll 12, it will contact the backup roll 14 and transmit the frictional force it has with the drive roll 12 to the backup roll 14. If this force has a component in the direction in which the paper is being driven greater than the biasing force on the backup roll 14, it will tend to push the backup roll 14 and cause it to pivot around the drive roll 12. As this pivotal movement occurs, the distance between the backup roll 14 and the drive roll 12 will increase until the backup roll 14 reaches a position 24, see FIG. 2, where the component of the frictional force pushing the backup roll 14, is equal to the biasing force urging the backup roll 14 to its home position. At this position 24 the backup roll 14 will stop pivoting. This pivotal distance is proportional to the thickness of the single sheet.

When multiple sheets of paper 28 are fed through this device the same frictional forces push the backup roll 14 to an ulterior position 25, see FIG. 3. At this position 25 the distance between the backup roll 14 and the drive roll 12 is proportional to the thickness of the combined multiple sheets 28 being fed. Again, the backup roll 14 will pivot no further than the position at which the component of the frictional force pushing the backup roll 14 equals the tension force of the spring. At whatever position backup roll 14 assumes, the paper will continue to be driven through the resulting nip area 21. As can be seen from the drawing, the pivotal position of the backup member 14 and thus the exiting point of the paper is dependent upon the number of sheets, i.e. the thickness of paper being fed. This position can be detected or the deflector plate 19 attached to the carriage 15 can be used to deflect the multiple sheets and prevent their disruption of the paper feeding process.

Having thus described a preferred embodiment of the present invention it will be understood that changes may be made in size, shape, or configuration of some of the parts of this device without departing from the present invention as described in the appended claims.

What is claimed is:

1. In combination with a sheet feeder, an apparatus for sensing the thickness of the sheet being fed comprising a frame, a drive roll for driving sheet material, means mounting said drive roll for rotation about a fixed axis in said frame, drive means for said drive roll, a cooperating back-up member positioned parallel and adjacent to said drive roll so as to form an elongate nip area therebetween, means mounting said back-up member, on a pivot axis offset from said fixed axis of said drive roll to afford the limited angular rotation of said back-up member about said pivot axis and the partial revolution of said back-up member around said drive roll, thereby increasing the nip spacing between said drive roll and said back-up member, said back-up member having a home position at which said nip area has a predetermined spacing and ulterior positions at which the spacing of said nip area is responsive to the thickness of the sheets being driven between said drive roll and said back-up member, whereby multiple sheets will interpose said nip area, and following the rotation of the drive roll, push said backup member about said pivot axis to one of said ulterior positions, and means for biasing said back-up member to said home position.

2. An apparatus as recited in claim 1 including deflection means cooperating with said back-up member such that the feeding of multiple sheets will cause said deflection means to deflect said multiple sheets.

3. An apparatus as recited in claim 1 wherein said back-up member is a roll mounted for rotation about an axis fixed within said pivotal mounting means.

* * * * *